US007021566B2

(12) United States Patent
Dallmeyer et al.

(10) Patent No.: US 7,021,566 B2
(45) Date of Patent: Apr. 4, 2006

(54) MODULAR FUEL INJECTOR WITH A DEEP POCKET SEAT AND METHOD OF MAINTAINING SPATIAL ORIENTATION

(75) Inventors: Michael P. Dallmeyer, Newport News, VA (US); William J. Imoehl, Williamsburg, VA (US); James P. Fochtman, Williamsburg, VA (US); Fredrick L. Barnes, Suffolk, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 138 days.

(21) Appl. No.: 10/642,628

(22) Filed: Aug. 19, 2003

(65) Prior Publication Data

US 2005/0040258 A1 Feb. 24, 2005

(51) Int. Cl.

| | |
|---|---|
| ***F02M 39/00*** | (2006.01) |
| ***F02M 59/00*** | (2006.01) |
| ***F02M 47/02*** | (2006.01) |
| ***B05B 1/30*** | (2006.01) |

(52) U.S. Cl. ..... 239/533.3; 239/533.2; 239/533.12; 239/88; 239/585.1; 239/585.5

(58) Field of Classification Search ..... 239/533.3, 239/533.1, 533.2, 533.9, 533.12, 88–93, 239/585.1–585.5; 251/129.15, 129.21, 127
See application file for complete search history.

(56) References Cited

U.S. PATENT DOCUMENTS

| | | | | |
|---|---|---|---|---|
| 5,372,313 | A * | 12/1994 | Chabon et al. | 239/585.3 |
| 5,996,911 | A * | 12/1999 | Gesk et al. | 239/585.1 |
| 6,079,642 | A | 6/2000 | Maier | 239/585.1 |
| 6,264,112 | B1 | 7/2001 | Landschoot et al. | 239/5 |
| 2002/0047054 | A1 | 4/2002 | Dallmeyer et al. | 239/585.1 |
| 2002/0100821 | A1 | 8/2002 | Yukinawa et al. | 239/585.1 |
| 2002/0130206 | A1 | 9/2002 | Kobayashi et al. | 239/585.4 |

OTHER PUBLICATIONS

PCT International Search Report filed Jun. 18, 2004 (PCT/US2004/019503) and date of mailing Oct. 10, 2004.

* cited by examiner

*Primary Examiner*—Davis Hwu

(57) ABSTRACT

A modular fuel injector that includes a coil group subassembly and a valve group subassembly. The coil group subassembly is independently testable. The valve group subassembly is independently testable and includes a tube assembly having a longitudinal axis extending between a first tube end and a second tube end, and a seat assembly disposed in the tube assembly proximate the second tube end. The seat assembly includes a flow portion and a securement portion. The flow portion extends along the longitudinal axis between a first surface and an orifice disk retention surface at a first length. The flow portion has a seat orifice extending therethrough and an orifice disk coupled to the orifice disk retention surface so that the orifice plate is aligned in a fixed spatial orientation with respect to the flow portion. The securement portion extends along the longitudinal axis away from the orifice disk retention surface at a second length greater than the first length. A method of maintaining a fixed spatial orientation and dimensional symmetry of at least one of the seat and orifice disk in the valve subassembly is disclosed.

21 Claims, 2 Drawing Sheets

MODULAR FUEL INJECTOR WITH A DEEP POCKET SEAT AND METHOD OF MAINTAINING SPATIAL ORIENTATION

BACKGROUND OF THE INVENTION

It is believed that a seat of a conventional fuel injector can be attached to a valve body by placing the seat and an orifice disk within the valve body and crimping a terminal portion of the valve body to retain the seat and the orifice disk within the valve body.

However, the crimping of the seat to the valve body may cause movement of the seat relative to a desired position in the valve body. Further, the seat, orifice disk, or the valve body may also distort at a location proximate the terminal end of the valve body.

The change in seat location relative to the valve body may cause the working gap between an armature and a pole piece of the conventional fuel injector to be changed, thereby changing the desired flow rate.

The distortion of the seat may cause the integrity of the sealing surface formed between a closure member and the seat to be changed, thereby potentially affecting emission due to leaks during a closed configuration of the fuel injector.

The distortion of the seat and/or the orifice disk may cause the fuel spray pattern and targeting to be unsuitable (e.g., insufficient atomization or inappropriate spray pattern) in the manifold or in the intake port of the engine.

Thus, it would be desirable to attach the seat to a valve body without the potential shortcomings of the conventional fuel injector. Moreover, it would be desirable to maintain symmetry of the seat and/or the orifice disc with respect to a longitudinal axis.

SUMMARY OF THE INVENTION

The present invention provides for, in one aspect, a fuel injector. The fuel injector comprises a coil group subassembly and a valve group subassembly. The coil group subassembly is independently testable and includes a solenoid coil, a coil housing surrounding a portion of the solenoid coil, and a first attaching portion disposed on the housing. The valve group subassembly is independently testable and includes a tube assembly having a longitudinal axis extending between a first tube end and a second tube end, an armature assembly disposed in the tube assembly, the armature assembly having a closure member, and a seat assembly disposed in the tube assembly proximate the second tube end. The tube assembly has a second attaching portion contiguous to the first attaching portion. The first and second attaching portions are fixedly connected proximate the second tube end. The seat assembly includes a flow portion and a securement portion. The flow portion extends along the longitudinal axis between a first surface and an orifice disk retention surface at a first length. The flow portion has a seat orifice extending therethrough and an orifice disk coupled to the orifice disk retention surface so that the orifice plate is aligned in a fixed spatial orientation with respect to the flow portion. The securement portion extends along the longitudinal axis away from the orifice disk retention surface at a second length greater than the first length.

In yet another aspect, the present invention provides for a method of maintaining a fixed spatial orientation of a seat and an orifice disk in a valve body of a valve subassembly that extends along a longitudinal axis. The method can be achieved by disposing the seat and the orifice disk in a valve body of the valve subassembly in a fixed spatial orientation; and welding the seat to the valve body so that the fixed spatial axial orientation is maintained with in a tolerance of ±0.5%.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
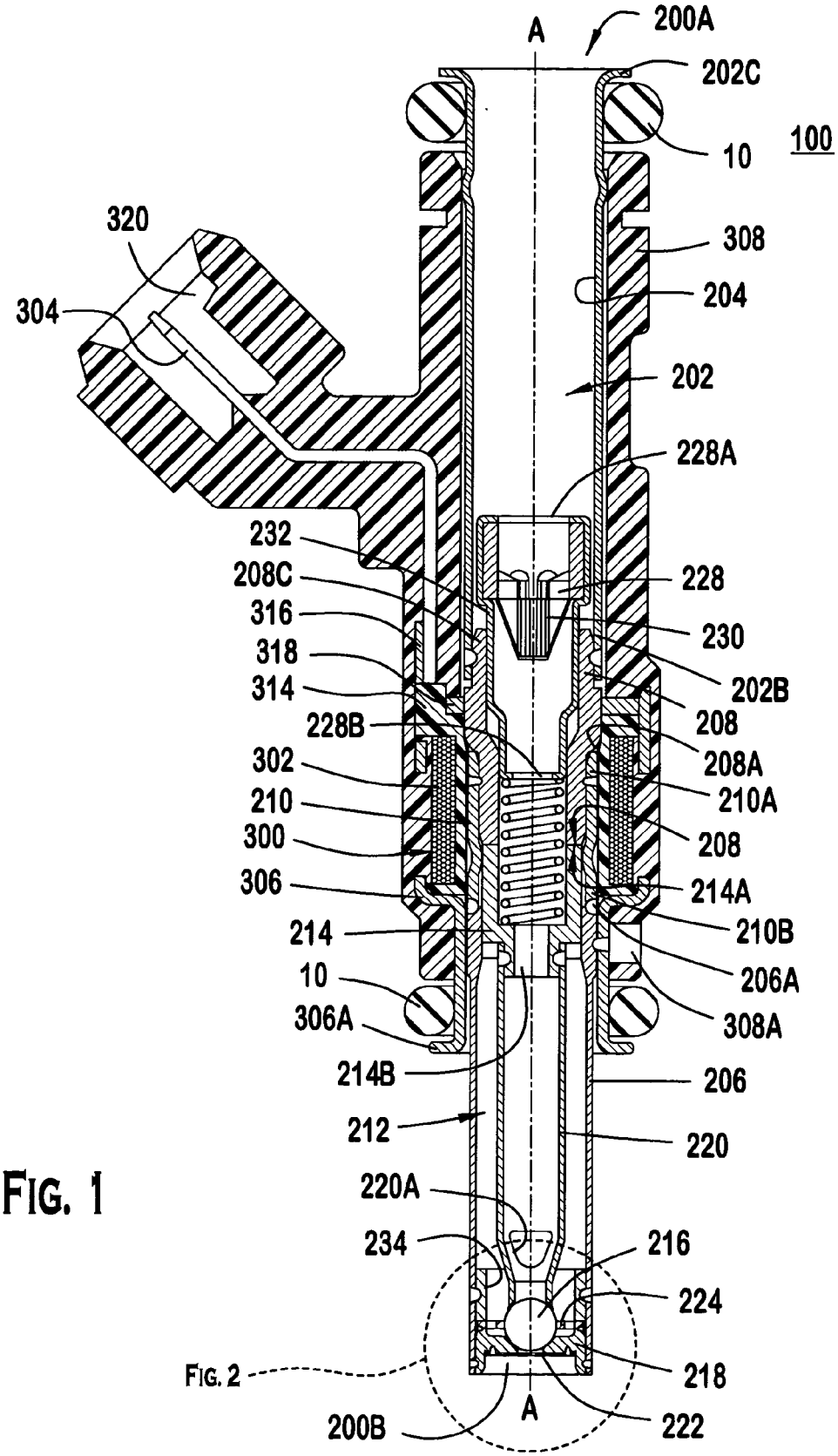
FIG. 1 is a representation of a fuel injector according a preferred embodiment.
Figure 2:
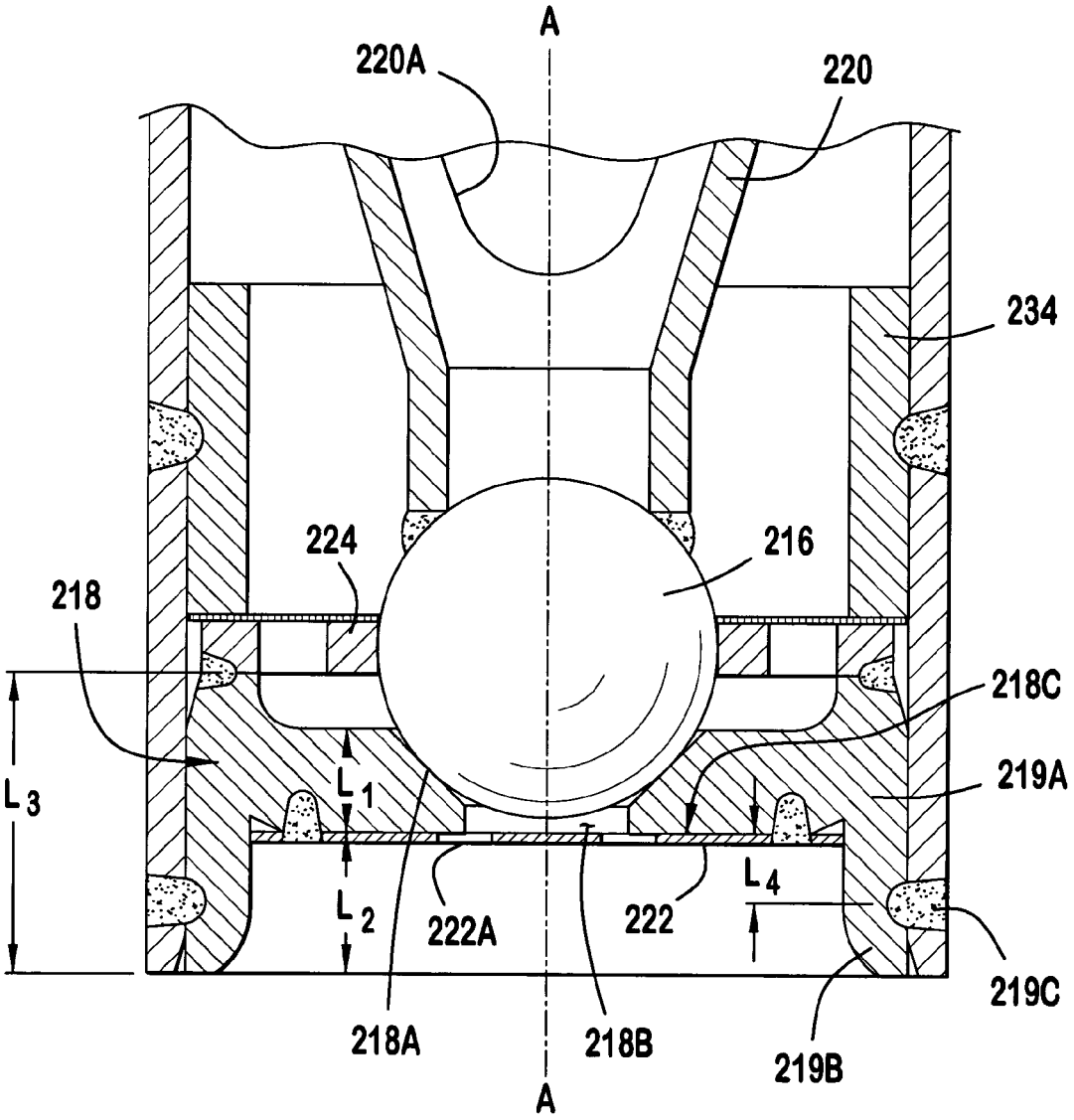
FIG. 2 is a close up of the outlet end of the fuel injector of FIG. 1.

Referring to FIGS. 1 and 2, a solenoid actuated fuel injector 100 dispenses a quantity of fuel that is to be combusted in an internal combustion engine (not shown). The fuel injector 100 extends along a longitudinal axis between a first injector end 200A and a second injector end, and includes a valve group subassembly 200 and a power group subassembly 300. The valve group subassembly 200 performs fluid handling functions, e.g., defining a fuel flow path and prohibiting fuel flow through the injector 100. The power group subassembly 300 performs electrical functions, e.g., converting electrical signals to a driving force for permitting fuel flow through the injector 100.

The valve group subassembly 200 includes a tube assembly extending along the longitudinal axis A—A between a first tube assembly end 200A and a second tube assembly end 200B. The tube assembly 202 can include at least an inlet tube 204, a non-magnetic shell 210, and a valve body 206. The inlet tube 204 has a first inlet tube end 202A proximate to the first tube assembly end 200A. Inlet tube 220 can be flared at the inlet end 202*a* into a flange 202*c* to retain the O-ring 10. A second inlet tube end 202B of the inlet tube 204 is connected to a first shell end 210A of the non-magnetic shell 210. A second shell end 210B of the non-magnetic shell 210 can be connected to a generally transverse planar surface of a first valve body end 206A of the valve body 206. A second valve body end 206B of the valve body 206 is disposed proximate to the second tube assembly end 200B. The inlet tube 204 can be formed by a deep drawing process or by a rolling operation. A pole piece can be integrally formed at the second inlet tube end 202B of the inlet tube 204 or, as shown, a separate pole piece 208 can be connected to the inlet tube 204 and connected to the first shell end 210A of the non-magnetic shell 210. The non-magnetic shell 210 can comprise non-magnetic stainless steel, e.g., 300 series stainless steels, or other materials that have similar structural and magnetic properties.

As shown in FIG. 1, inlet tube 204 is attached to pole piece 208 by means of welds. Formed into the outer surface of pole piece 208 are pole piece shoulders 208A, which, in conjunction with mating shoulders 208B of a bobbin of the coil subassembly, act as positive mounting stops when the two subassemblies are assembled together. The length of pole piece 208 is fixed whereas the length of the inlet tube 204 can vary according to operating requirements. By forming inlet tube 204 separately from pole piece 208, different length injectors can be manufactured by using different inlet tube lengths during the assembly process. The inlet tube 204 can be attached to the pole piece 208 at an inner circumferential surface of the pole piece 208. Alternatively, an integral inlet tube and pole piece can be attached to the inner circumferential surface of a non-magnetic shell 210.

An armature assembly 212 is disposed in the tube assembly 202. The armature assembly 212 includes a first armature assembly end having a ferro-magnetic or armature portion 214 and a second armature assembly end having a sealing portion. The armature assembly 212 is disposed in the tube assembly 202 such that the magnetic portion, or "armature," 214 confronts the pole piece 208. The sealing portion can include a closure member 216, e.g., a spherical valve element, that is moveable with respect to the seat 218 and its sealing surface 218A. The closure member 216 is movable between a closed configuration, as shown in FIG. 1, and an open configuration (not shown). In the closed configuration, the closure member 216 contiguously engages the sealing surface 218A to prevent fluid flow through the opening. In the open configuration, the closure member 216 is spaced from the seat 218 to permit fluid flow through the opening. The armature assembly 212 may also include a separate intermediate portion 220 connecting the ferro-magnetic or armature portion 214 to the closure member 216. The intermediate portion or armature tube 220 can be fabricated by various techniques, for example, a plate can be rolled and its seams welded or a blank can be deep-drawn to form a seamless tube. The intermediate portion 220 is preferable due to its ability to reduce magnetic flux leakage from the magnetic circuit of the fuel injector 100. This ability arises from the fact that the intermediate portion or armature tube 220 can be non-magnetic, thereby magnetically decoupling the magnetic portion or armature 214 from either of the closure member 216 or the seat 218. Because the ferro-magnetic closure member 216 is decoupled from the ferro-magnetic or armature 214, flux leakage is reduced, thereby improving the efficiency of the magnetic circuit. Preferably, the armature assembly 212 includes the armature tube 220, elongated openings 220A and the closure member 216.

Surface treatments can be applied to at least one of the end portions 208B and 214A to improve the armature's response, reduce wear on the impact surfaces and variations in the working air gap between the respective end portions 208B and 214A. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbonitriding, cyaniding, heat, flame, spark or induction hardening.

The surface treatments will typically form at least one layer of wear-resistant materials on the respective end portions 208B and 214A. These layers, however, tend to be inherently thicker wherever there is a sharp edge, such as between junction between the circumference and the radial end face of either portions. Moreover, this thickening effect results in uneven contact surfaces at the radially outer edge of the end portions. However, by forming the wear-resistant layers on at least one of the end portions 208B and 214A, where at least one end portion has a surface generally oblique to longitudinal axis A—A, both end portions are now substantially in mating contact with respect to each other.

Since the surface treatments may affect the physical and magnetic properties of the ferromagnetic portion of the armature assembly 212 or the pole piece 208, a suitable material, e.g., a mask, a coating or a protective cover, surrounds areas other than the respective end portions 208B and 214A during the surface treatments. Upon completion of the surface treatments, the material is removed, thereby leaving the previously masked areas unaffected by the surface treatments.

Fuel flow through the armature assembly 212 can be provided by at least one axially extending through-bore 214B and at least one apertures 220A through a wall of the armature assembly 212. The apertures 220A, which can be of any shape, are preferably non-circular, e.g., axially elongated, to facilitate the passage of gas bubbles. For example, in the case of a separate intermediate portion 220 that is formed by rolling a sheet substantially into a tube, the apertures 220A can be an axially extending slit defined between non-abutting edges of the rolled sheet. However, the apertures 220A, in addition to the slit, would preferably include openings extending through the sheet. The apertures 220A provide fluid communication between the at least one through-bore 214B and the interior of the valve body 206. Thus, in the open configuration, fuel can be communicated from the through-bore 214B, through the apertures 220A and the interior of the valve body 206, around the closure member 216, and through metering orifice openings of an orifice disk 222 into the engine (not shown).

As a further alternative, a two-piece armature having an armature portion directly connected to a closure member can be utilized. Although both the three-piece and the two-piece armature assemblies are interchangeable, the three-piece armature assembly is preferable due to its ability to reduce magnetic flux leakage from the magnetic circuit of the fuel injector 100 according to the present invention. It should be noted that the armature tube 220 or 220A of the three-piece armature assembly can be fabricated by various techniques, for example, a plate can be rolled and its seams welded or a blank can be deep-drawn to form a seamless tube.

The seat 218 is secured at the second end of the tube assembly 202. The seat 218 includes a flow portion 219A and a securement portion 219B. The flow portion 219A extends generally along the longitudinal axis A—A over a first length L1, and the securement portion 219B extends generally along the longitudinal axis over a second length L2 such that the second length is at least equal to the first length L1 and preferably greater than L1. Both portions extend generally along the longitudinal axis over a third length L3 greater than either one of L1 or L2.

The flow portion 219A of the seat 218 defines a sealing surface 218A and an opening 218B preferably centered on the axis A—A and through which fuel can flow into the internal combustion engine (not shown). The sealing surface 218A surrounds the opening 218B. The opening 218B is coterminus with an orifice disk retention surface 218C. The sealing surface 218A, which faces the interior of the valve body 206, can be frustoconical or concave in shape, and can have a finished surface. An orifice disk 222 can be used in connection with the seat 218 to provide at least one precisely sized and oriented orifice 222A in order to obtain a particular fuel spray pattern and targeting. The precisely sized and oriented orifice 222A can be disposed on the center axis of the orifice disk 222 or, preferably disposed off-axis, and oriented in any desirable angular configuration relative to one or more reference points on the fuel injector 100. It should be noted here that both the valve seat 218 and orifice disk 222 are fixedly attached to the valve body 206 by known conventional attachment techniques, including, for example, laser welding, crimping, and friction welding or conventional welding. The orifice disk 222 is preferably tack welded to the orifice disk retention surface 218C of the seat 218 in a fixed spatial orientation to provide the particular fuel spray pattern and targeting of the fuel spray.

The securement portion 219B of the seat 218 allows a dimensional symmetry of at least one of the seat 218 and the orifice disk 222 relative to the longitudinal axis and the fixed spatial orientation of the seat 218 and the orifice disk 222 relative to at least one of the seat 218 and disk retention surface 218C to be maintained even after the seat is secured to the valve body. The securement portion 219B can be attached to the valve body by a suitable technique, such as, for example, tack welding or by bonding. Preferably, the securement portion 219B is secured to the inner surface of the valve body 206 with a continuous laser seam weld 219C extending from the outer surface through the inner surface of the valve body 206 and into a portion of the securement portion 219B over the entire circumference of the valve body about the longitudinal axis such that the seam weld 219C forms a hermetic lap seal between the inner surface of the valve body and the outer surface of the securement portion 219B. Also preferably, the seam weld 219C has its center located at a location over an approximate fourth length of L4 along the longitudinal axis of about 50% of the second length L2 from the orifice disk retention surface 218C. By locating the seam weld 219C at such a position from the flow portion 219B is sufficiently far from the sealing surface 218A, orifice 218B and orifice disk 222 such that a fixed configuration of the orifice disk 222 relative to the seat 218 prior to their installation in the valve body 206 is maintained within a tolerance of ±0.5% and that the dimensional symmetry (i.e., circularity roundness, perpendicularity or a quantifiable measurement of distortion) of the seat 218 or the orifice disk 222 about the longitudinal axis A—A is approximately less than 1% as compared to such measurements prior to the seat being secured in the valve body.

In the case of a spherical valve element providing the closure member 216, the spherical valve element can be connected to the armature assembly 212 at a diameter that is less than the diameter of the spherical valve element. Such a connection would be on side of the spherical valve element that is opposite contiguous contact with the seat 218. A lower armature assembly guide 224 can be disposed in the tube assembly 202, proximate the seat 218, and would slidingly engage the diameter of the spherical valve element. The lower armature assembly guide 224 can facilitate alignment of the armature assembly 212 along the axis A—A.

A resilient member 226 is disposed in the tube assembly 202 and biases the armature assembly 212 toward the seat 218. A filter assembly 228 comprising a filter 230 and a preload adjuster 232 is also disposed in the tube assembly 202. The filter assembly 228 includes a first filter assembly end 228A and a second filter assembly end 228B. The filter 230 is disposed at one end of the filter assembly 228 and also located proximate to the first end 200A of the tube assembly 202 and apart from the resilient member 226 while the preload adjuster 232 is disposed generally proximate to the second end of the tube assembly 202. The preload adjuster 232 engages the resilient member 226 and adjusts the biasing force of the member 226 with respect to the tube assembly 202. In particular, the preload adjuster 232 provides a reaction member against which the resilient member 226 reacts in order to close the injector valve 100 when the power group subassembly 300 is de-energized. The position of the preload adjuster 232 can be retained with respect to the inlet tube 204 by an interference press-fit between an outer surface of the preload adjuster 232 and an inner surface of the tube assembly 202. Thus, the position of the preload adjuster 232 with respect to the inlet tube 204 can be used to set a predetermined dynamic characteristic of the armature assembly 212.

The valve group subassembly 200 can be assembled as follows. The non-magnetic shell 210 is connected to the inlet tube 204 and to the valve body 206. The filter assembly 228 is inserted along the axis A—A from the first end 200A of the tube assembly 202. Next, the resilient member 226 and the armature assembly 212 (which was previously assembled) are inserted along the axis A—A from the injector outlet end 200B of the valve body 206. The adjusting tube 232, the filter assembly 228 can be inserted into the inlet tube 204 to a predetermined distance so as to permit the adjusting tube 232 to preload the resilient member 226. Positioning of the filter assembly 228, and hence the adjusting tube 232 with respect to the inlet tube 204 can be used to adjust the dynamic properties of the resilient member 226, e.g., so as to ensure that the armature assembly 212 does not float or bounce during injection pulses. The seat 218 and orifice disk 222 are then inserted along the axis A—A from the second valve body end 206B of the valve body 206. The seat 218 and orifice disk 222 can be fixedly attached to one another or to the valve body 206 by known attachment techniques such as laser welding, crimping, friction welding, conventional welding, etc. Other preferred variations of the valve group subassembly 200 are described and illustrated in U.S. Patent Publication No. 20020047054 published on Apr. 25, 2002, which is hereby incorporated by reference in its entirety.

The power group subassembly 300 comprises an electromagnetic coil 302, at least one terminal 304, a coil housing 306, and an overmold 308. The electromagnetic coil 302 comprises a wire 302A that that can be wound on a bobbin 314 and electrically connected to electrical contacts 316 on the bobbin 314. When energized, the coil 302 generates magnetic flux that moves the armature assembly 212 toward the open configuration, thereby allowing the fuel to flow through the opening. De-energizing the electromagnetic coil 302 allows the resilient member 226 to return the armature assembly 212 to the closed configuration, thereby shutting off the fuel flow. The housing, which provides a return path for the magnetic flux, generally includes a ferro-magnetic cylinder surrounding the electromagnetic coil 302 and a flux washer 318 extending from the cylinder toward the axis A—A. The flux washer 318 can be integrally formed with or separately attached to the cylinder. The coil housing 306 can include holes, slots, or other features to break-up eddy currents that can occur when the coil 302 is energized.

The overmold 308 maintains the relative orientation and position of the electromagnetic coil 302, the at least one terminal (two are used in the illustrated example), and the coil housing 306. The overmold 308 includes an electrical harness connector 320 portion in which a portion of the terminal 304 is exposed. The terminal 304 and the electrical harness connector 320 portion can engage a mating connector, e.g., part of a vehicle wiring harness (not shown), to facilitate connecting the injector 100 to an electrical power supply (not shown) for energizing the electromagnetic coil 302.

According to a preferred embodiment, the magnetic flux generated by the electromagnetic coil 302 flows in a circuit that includes the pole piece 208, the armature assembly 212, the valve body 206, the coil housing 306, and the flux washer 318. The magnetic flux moves across a parasitic airgap between the homogeneous material of the magnetic portion or armature 214 and the valve body 206 into the armature assembly 212 and across a working air gap between end portions 208B and 214A towards the pole piece 208, thereby lifting the closure member 216 away from the seat 218. As can further be seen in FIG. 1, the width of the impact surface 208B of pole piece 208 is greater than the width of the cross-section of the impact surface 214A of magnetic portion or armature 214. The smaller cross-sectional area allows the ferro-magnetic portion 214 of the armature assembly 212 to be lighter, and at the same time, causes the magnetic flux saturation point to be formed near the working air gap between the pole piece 208 and the ferro-magnetic portion 214, rather than within the pole piece 208. Furthermore, since the armature 214 is partly within the interior of the electromagnetic coil 302, the magnetic flux is denser, leading to a more efficient electromagnetic coil. Finally, because the ferro-magnetic closure member 216 is magnetically decoupled from the ferro-magnetic or armature portion 214 via the armature tube 220, flux leakage of the magnetic circuit is reduced, thereby improving the efficiency of the electromagnetic coil 302.

The coil group subassembly 300 can be constructed as follows. A plastic bobbin 314 can be molded with at least one electrical contact 316. The wire 302A for the electromagnetic coil 302 is wound around the plastic bobbin 314 and connected to the electrical contacts 316. The coil housing 306 is then placed over the electromagnetic coil 302 and bobbin 314. A terminal 304, which is pre-bent to a proper shape, is then electrically connected to each electrical contact 322. An overmold 308 is then formed to maintain the relative assembly of the coil/bobbin unit, coil housing 306, and terminal 304. The overmold 308 also provides a structural case for the injector and provides predetermined electrical and thermal insulating properties. A separate collar can be connected, e.g., by bonding, and can provide an application specific characteristic such as an orientation feature or an identification feature for the injector 100. Thus, the overmold 308 provides a universal arrangement that can be modified with the addition of a suitable collar. To reduce manufacturing and inventory costs, the coil/bobbin unit can be the same for different applications. As such, the terminal 304 and overmold 308 (or collar, if used) can be varied in size and shape to suit particular tube assembly 202 lengths, mounting configurations, electrical connectors, etc.

Alternatively, a two-piece overmold allows for a first overmold portion that is application specific while a second overmold portion can be for all applications. The first overmold portion can be bonded to the second overmold portion, allowing both to act as electrical and thermal insulators for the injector. Additionally, a portion of the coil housing 306 can extend axially beyond an end of the overmold 308 to allow the injector to accommodate different length injector tips. The extended portion also can be formed with a flange 306A to retain a sealing member such as, for example, an O-ring 10. Other preferred embodiments of the coil group subassembly 300 are described and illustrated in U.S. Patent Publication No. 20020047054 published on Apr. 25, 2002, which is hereby incorporated by reference in its entirety.

The valve group subassembly 200 can be inserted into the coil group subassembly 300 to form a complete fuel injector 100. Thus, the injector 100 is made of two modular subassemblies that can be assembled and tested separately from each other with a calibrated test apparatus (not shown), and then connected together to form the injector 100. The valve group subassembly 200 and the coil group subassembly 300 can be fixedly attached by adhesive, welding, or another equivalent attachment process. According to a preferred embodiment, a hole 308A through the overmold 308 exposes the coil housing 306 and provides access for laser welding the coil housing 306 to the valve body 206. The filter and the retainer, which may be an integral unit, can be connected to the first tube assembly end 200A of the tube unit. The O-rings can be mounted at the respective first and second injector ends.

The first injector end 200A can be coupled to the fuel supply of an internal combustion engine (not shown). The O-ring 10 can be used to seal the first injector end 200A to the fuel supply so that fuel from a fuel rail (not shown) is supplied to the tube assembly 202, with the O-ring 10 making a fluid tight seal, at the connection between the injector 100 and the fuel rail (not shown).

To set the lift, i.e., ensure the proper injector lift distance, there are at least four different techniques that can be utilized. According to a first technique, a crush ring or a washer that is inserted into the valve body 206 between the lower guide 257 and the valve body 206 can be deformed. According to a second technique, the relative axial position of the valve body 206 and the non-magnetic shell 210 can be adjusted before the two parts are affixed together. According to a third technique, the relative axial position of the non-magnetic shell 210 and the pole piece 208 can be adjusted before the two parts are affixed together. And according to a fourth and preferred technique, a lift sleeve 234 can be displaced axially within the valve body 206. If the lift sleeve technique is used, the position of the lift sleeve 234 can be adjusted by moving the lift sleeve 234 axially. The lift distance can be measured with a test probe (not shown). Once the desired lift is reached, the sleeve is welded to the valve body 206, e.g., by laser welding. Next, the valve body 206 is attached to the inlet tube 204 assembly by a weld, preferably a laser weld. The assembled fuel group subassembly 200 is then tested, e.g., for leakage.

The preparation of the power group sub-assembly, which can include (a) the coil housing 306, (b) the bobbin assembly including the terminals 304, (c) the flux washer 318, and (d) the overmold 308, can be performed separately from the fuel group subassembly.

According to a preferred embodiment, wire 302A is wound onto a pre-formed bobbin 314 having electrical connector portions 322 to form a bobbin assembly. The bobbin assembly is inserted into a pre-formed coil housing 306. To provide a return path for the magnetic flux between the pole piece 208 and the coil housing 306, flux washer 318 is mounted on the bobbin assembly. A pre-bent terminal 304 having axially extending connector portions are coupled to the electrical contact portions 316 of the coil and brazed, soldered welded, or, preferably, resistance welded. The partially assembled power group assembly is now placed into a mold (not shown). By virtue of its pre-bent shape, the terminals 304 will be positioned in the proper orientation with the harness connector 320 when a polymer is poured or injected into the mold. Alternatively, two separate molds (not shown) can be used to form a two-piece overmold as described earlier. The assembled power group subassembly 300 can be mounted on a test stand to determine the solenoid's pull force, coil resistance and the drop in voltage as the solenoid is saturated during energization of the coil.

The inserting of the fuel group subassembly 200 into the power group subassembly 300 operation can involve setting the relative rotational orientation of fuel group subassembly 200 with respect to the power group subassembly 300. According to the preferred embodiments, the fuel group and the power group subassemblies can be rotated such that the included angle between the reference point(s) on the orifice disk 222 (including opening(s) thereon) and a reference point on the injector harness connector 320 are within a predetermined angle. The relative orientation can be set using robotic cameras or computerized imaging devices to look at respective predetermined reference points on the subassemblies, calculate the angular rotation necessary for alignment, orientating the subassemblies and then checking with another look and so on until the subassemblies are properly orientated. Once the desired orientation is achieved, the subassemblies are inserted together. The inserting operation can be accomplished by one of two methods: "top-down" or "bottom-up." According to the former, the power group subassembly 300 is slid downward from the top of the fuel group subassembly 200, and according to the latter, the power group subassembly 300 is slid upward from the bottom of the fuel group subassembly 200. In situations where the inlet tube 204 assembly includes a flared first end, bottom-up method is required. Also in these situations, the O-ring 10 that is retained by the flared first end can be positioned around the power group subassembly 300 prior to sliding the fuel group subassembly 200 into the power group subassembly 300. After inserting the fuel group subassembly 200 into the power group subassembly 300, these two subassemblies are affixed together, e.g., by welding, such as laser welding. According to a preferred embodiment, the overmold 308 includes an opening 308A that exposes a portion of the coil housing 306. This opening 308A provides access for a welding implement to weld the coil housing 306 with respect to the valve body 206. Of course, other methods or affixing the subassemblies with respect to one another can be used. Finally, the O-ring 10 at either end of the fuel injector can be installed.

In operation, the electromagnetic coil 302 is energized, thereby generating magnetic flux in the magnetic circuit. The magnetic flux moves armature assembly 212 (along the axis A—A, according to a preferred embodiment) towards the integral pole piece 208, i.e., closing the working air gap. This movement of the armature assembly 212 separates the closure member 216 from the seat 218 and allows fuel to flow from the fuel rail (not shown), through the inlet tube 204, the through-bore 214B, the apertures 220A and the valve body 206, between the seat 218 and the closure member 216, through the opening, and finally through the orifice disk 222 into the internal combustion engine (not shown). When the electromagnetic coil 302 is de-energized, the armature assembly 212 is moved by the bias of the resilient member 226 to contiguously engage the closure member 216 with the seat 218, and thereby prevent fuel flow through the injector 100.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

We claim:

1. A fuel injector comprising:

a coil group subassembly being independently testable, the coil group subassembly including:

a solenoid coil;

a coil housing surrounding a portion of the solenoid coil; and a first attaching portion disposed on the housing; and a valve group subassembly being independently testable, the valve group subassembly including:

a tube assembly having a longitudinal axis extending between a first tube end and a second tube end, the tube assembly having a second attaching portion contiguous to the first attaching portion, the first and second attaching portions being fixedly connected proximate the second tube end;

an armature assembly disposed in the tube assembly, the armature assembly having a closure member; and a seat assembly disposed in the tube assembly proximate the second tube end, the seat assembly including:

a flow portion, the flow portion extending along the longitudinal axis between a first surface and an orifice disk retention surface at a first length, the flow portion having a seat orifice extending therethrough;

an orifice disk coupled to the orifice disk retention surface so that the orifice plate is aligned in a fixed spatial orientation with respect to the flow portion; and a securement portion, the securement portion extending along the longitudinal axis away from the orifice disk retention surface at a second length greater than the first length.

2. The fuel injector of claim 1, further comprising at least one weld extending from an outer surface of the tube assembly to the outer surface of the securement portion at a location distal to the flow portion so that the seat and the orifice disk generally maintains its fixed spatial orientation with the flow portion.

3. The fuel injector of claim 1, further comprising at least one weld extending from an outer surface of the tube assembly to the outer surface of the securement portion at a location distal to the flow portion so as to form a generally hermetic seal between the tube assembly and the seat.

4. The fuel injector of claim 1, further comprising at least one weld extending from an outer surface of the tube assembly to the outer surface of the securement portion at a location distal to the flow portion so that the seat maintains a dimensional symmetry about the longitudinal axis after the application of the at least one weld.

5. The fuel injector of claim 1, wherein the at least one weld is located on the outer surface of the tube assembly at a length of approximately 50% of the second length along the longitudinal axis.

6. The fuel injector of claim 5, wherein the armature assembly comprises an armature portion and a tubular portion, the tubular portion being connected to a closure member by at least one weld.

7. The fuel injector of claim 6, wherein the pole piece and armature portion comprise respective end face portions generally orthogonal to the longitudinal axis and one of the end face portions having a surface oblique to the longitudinal axis, the oblique surface including a coating being formed thereon.

8. The fuel injector of claim 5, wherein the coil housing comprises a first housing portion cincturing a portion of the solenoid coil and a second housing portion cincturing a portion of the valve body, the second housing portion having a flange to retain a sealing member.

9. The fuel injector of claim 5, wherein the tube assembly comprises: an inlet tube having a first end and a second end being coupled to a valve body, the second end of the inlet tube having an end portion confronting an end portion of the armature;

a filter being disposed proximate the first end of the inlet tube; a resilient member having one portion disposed proximate the second end of the inlet tube and another portion disposed within a pocket in the armature;

an adjusting tube being located within the inlet tube, the adjusting tube engaging the one portion of the resilient member so as to bias the closure member towards a position occluding flow through the seat orifice.

10. The fuel injector of claim 9, wherein the inlet tube, filter, resilient member, adjusting tube, magnetic coil, valve body, armature assembly and seat are symmetrical about the longitudinal axis.

11. The fuel injector of claim 10, wherein the armature assembly comprises a non-magnetic armature tube connecting an armature to a closure member, the non-magnetic armature tube decoupling a flow of magnetic flux between the armature and the seat.

12. The fuel injector of claim 11, wherein the closure member comprises a spheroidal member having a diameter greater than the diameter of the armature tube.

13. The fuel injector of claim 12, wherein the inlet tube further comprises a first tube coupled to a pole piece.

14. The fuel injector of claim 13, wherein the flow portion comprises:

first and second spaced apart generally planar surfaces disposed about the longitudinal axis, the first and second spaced apart surfaces; and a sealing surface co-terminus with one of the first and second spaced apart generally planar surfaces and contiguous to the seat orifice.

15. The fuel injector of claim 14, wherein the securement portion comprises: a perimeter cincturing the flow portion and extending along the longitudinal axis between a first perimeter end and a second perimeter end over a third length greater than the second length.

16. The fuel injector of claim 15, wherein seat further comprises a guide member contiguous to the first perimeter end of the seat, the guide member being provided with a central through opening along the longitudinal axis and a plurality of through openings disposed about the central opening, the central through opening guiding the closure member along the longitudinal axis between the first position where the closure member occludes fuel flow through the seat orifice and the second position where the closure member is spaced from the seat orifice so as to permit fuel flow through the seat orifice.

17. The fuel injector of claim 16, wherein the seat further comprises an orifice disk connected to the second surface of the seat, the orifice disk having a plurality of through openings being disposed about the longitudinal axis and in fluid communication with the seat orifice.

18. The fuel injector of claim 17, wherein the armature tube comprises at least one opening generally orthogonal to the longitudinal axis and extending through the surface of the armature tube.

19. The fuel injector of claim 17, wherein the armature tube comprises an inner surface telescoping over an outer surface of a first portion of the armature, the inner surface of the armature tube being connected to the outer surface of the armature by at least one weld extending from the inner surface of the armature tube to the outer surface of the armature.

20. The fuel injector of claim 19, wherein the armature tube comprises a deep drawn tube.

21. The fuel injector of claim 19, wherein the armature tube comprises a tube having a length with respect to the longitudinal axis greater than a length of the armature with respect to the longitudinal axis.

* * * * *